United States Patent [19]

Lapeyre

[11] 3,957,006

[45] May 18, 1976

[54] WATER TRANSPORTABLE PUMP STATION

[76] Inventor: Pierre A. Lapeyre, P.O. Box 430, Houma, La. 70360

[22] Filed: May 10, 1974

[21] Appl. No.: 468,646

[52] U.S. Cl. ..... 114.5 R; 61/1 R; 239/182

[51] Int. Cl.[2] ..... B63B 35/00

[58] Field of Search ..... 114/5 R, 74 R, 74 A, 114/74 T, 125, 185 R, .5 F; 115/11, 12 R, 14, 16; 239/146, 172, 178, 182, 193, 194, 199, 200; 415/7; 417/61; 61/1 R, 10, 12, 18, 22 R, 26, 30

[56] References Cited

UNITED STATES PATENTS

| | | | |
|---|---|---|---|
| 1,943,152 | 1/1934 | Weiss | 239/182 |
| 3,076,205 | 2/1963 | Schultz | 114/.5 T |
| 3,191,568 | 6/1965 | Schroeder et al. | 114/74 R |
| 3,617,146 | 11/1971 | Garland | 415/7 |
| 3,630,161 | 12/1971 | Georgii | 114/.5 T |

*Primary Examiner*—Trygve M. Blix
*Assistant Examiner*—Jesus D. Sotelo
*Attorney, Agent, or Firm*—Wilkinson, Mawhinney & Theibault

[57] ABSTRACT

The present disclosure is directed to transportable pumping station which is erected on a barge which may be transported on water to a site and the barge flooded to the river or water bottom so that pump intakes are supplied with intake water free of debris by screening the water to be pumped. If it is desired to relocate the pumping station wall covers are applied to the water intakes in the barge end walls and the barge is pumped dry and towed to the relocation site by tug boat and flooded down at the new site.

2 Claims, 5 Drawing Figures

WATER TRANSPORTABLE PUMP STATION

An object of the present invention is to provide a transportable pumping station supported on a high quality permanent concrete barge which protects the pumping equipment through a heavier concrete foundation and a large free area of suction sump screen.

Another object of the present invention is to provide a pumping station having anti-vortex baffling and which station is refloatable for water transport to a new site should such a need arise.

A further object of the present invention is the construction of a pumping station on a barge which permits of plant assembly with improved workmanship on the station due to the availability of better craftsman at a plant site rather than at pumping station sites.

With the foregoing and other objects in view the invention will be more fully described hereinafter and more particularly pointed out in the appended claims.

In the drawings in which like parts are denoted by reference characters throughout the several views.

Figure 1:
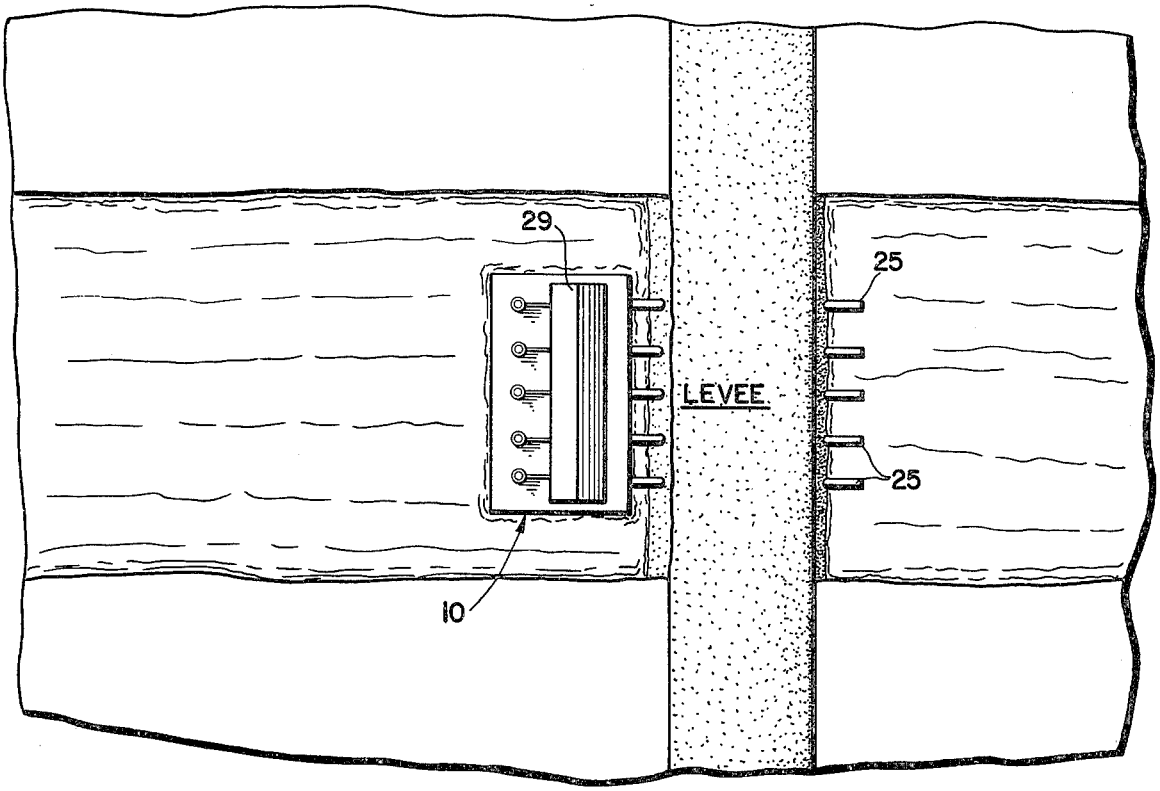
FIG. 1 is a top plan view of the pumping station of the present invention installed at a pumping site on a canal having a levee thereacross.
Figure 2:
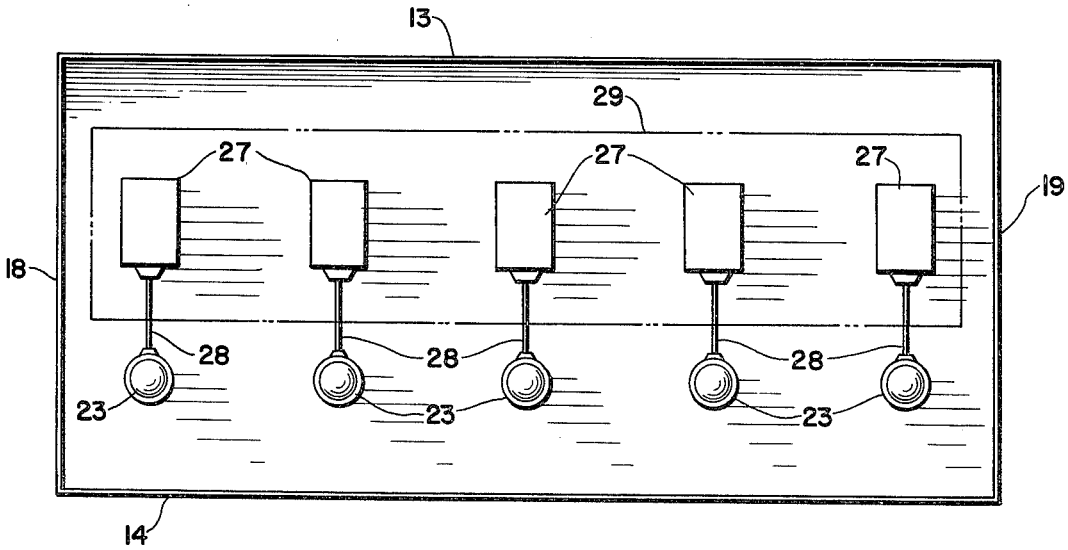
FIG. 2 is a top plan view of a pumping station constructed in accordance with the present invention.
Figure 3:
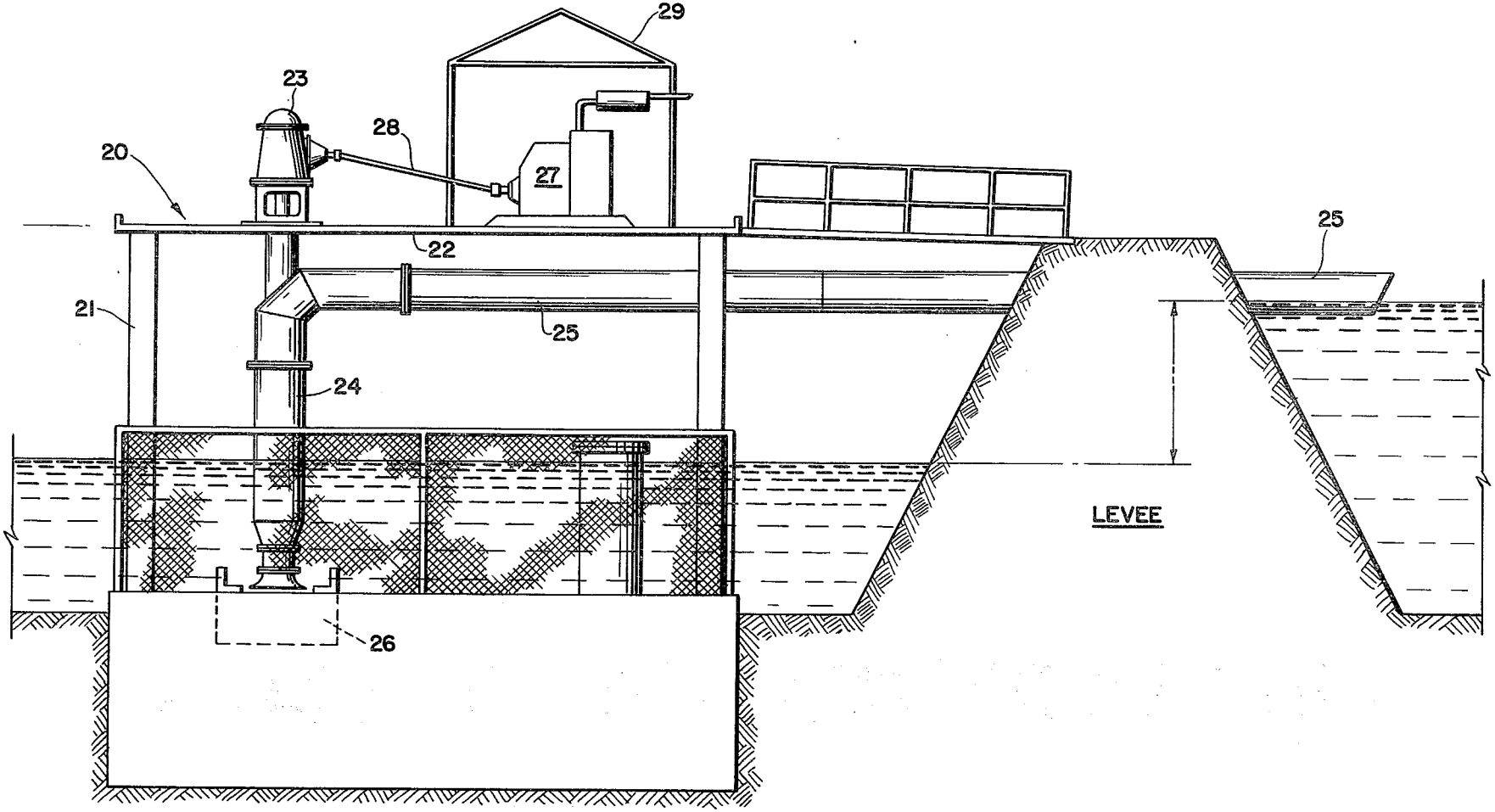
FIG. 3 is a longitudinal sectional view of the water transportable pumping station of the present invention in operating position at a pumping site.

Referring more particularly to the drawings, 10 designates a floatable-submersible barge having a top 11 and bottom 12 with a front end wall 13 and a rear end wall 14. The rear end wall 14 has a plurality of openings 15 therethrough over which are mounted removable covers 16 and screens 17. The barge 10 has side walls 18 and 19 which together with the foregoing defines a buoyant barge structure which may be water transported to the pumping station site and there flooded down in and with the source of water to be pumped.

Supported upon and secured to the barge 10 is a superstructure 20, which may be either of reinforced concrete or structural steel, having vertical risers 21 and horizontal support members 22. This structure may be of bolted or welded jointed construction.

Carried by the superstructure 20 are a plurality of pumps 23 having intake ducts 24 which pass through the top 11 of barge 10 so that the ducts will be below the water level in the barge when the barge is flooded down at the pumping site. Each pump 23 has a discharge duct 25 of elongated construction so that the discharge duct may be passed through or supported by a levee or dam barrier which separates the body of water being pumped from the body of water into which the pumping station pumps. The bottom of the intakes 24 may be equipped with vortex baffles 26.

Prime movers 27 of either the gasoline or diesel type are mounted on the superstructure 20 and drive the pumps 23 through shafts 28. A weather housing 29 is provided over the prime movers 27 to protect same from adverse weather conditions.

Figure 4:
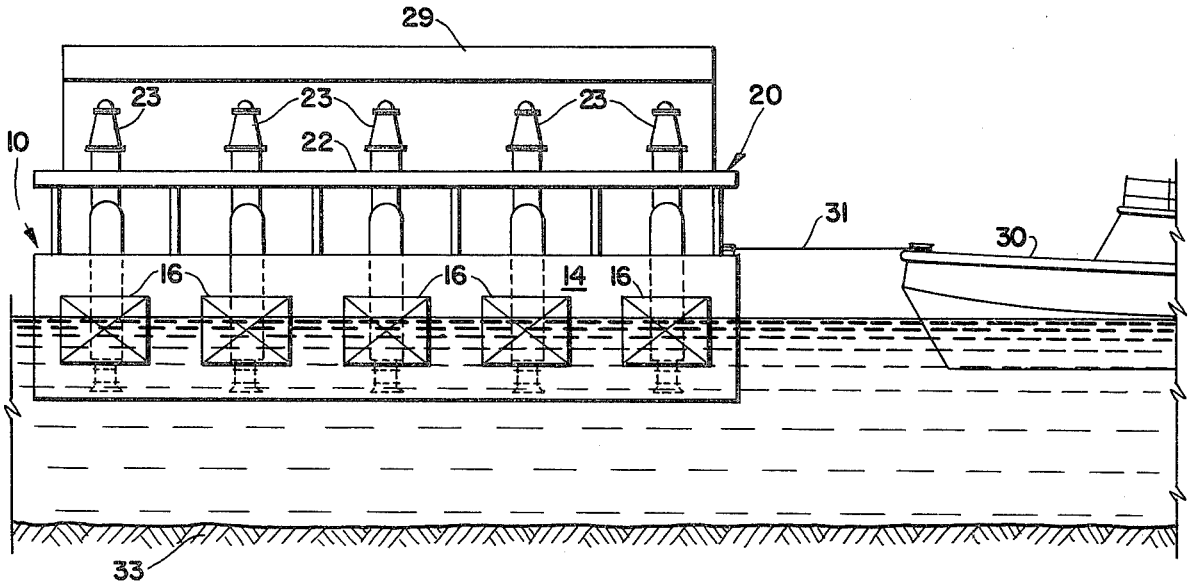
FIG. 4 is a rear elevational view of the water transportable pumping station of the present invention in its water transport mode.

With the structure constructed as above described at the construction site adjacent to a waterway; the covers 16 are put in place over the openings 15 to render the barge 10 a water tight buoyant structure and the same is floated or launched into the waterway where a tugboat 30 attaches a towline 31 as shown in FIG. 4 and tows the barge to the site where the station is to be operated.

Figure 5:
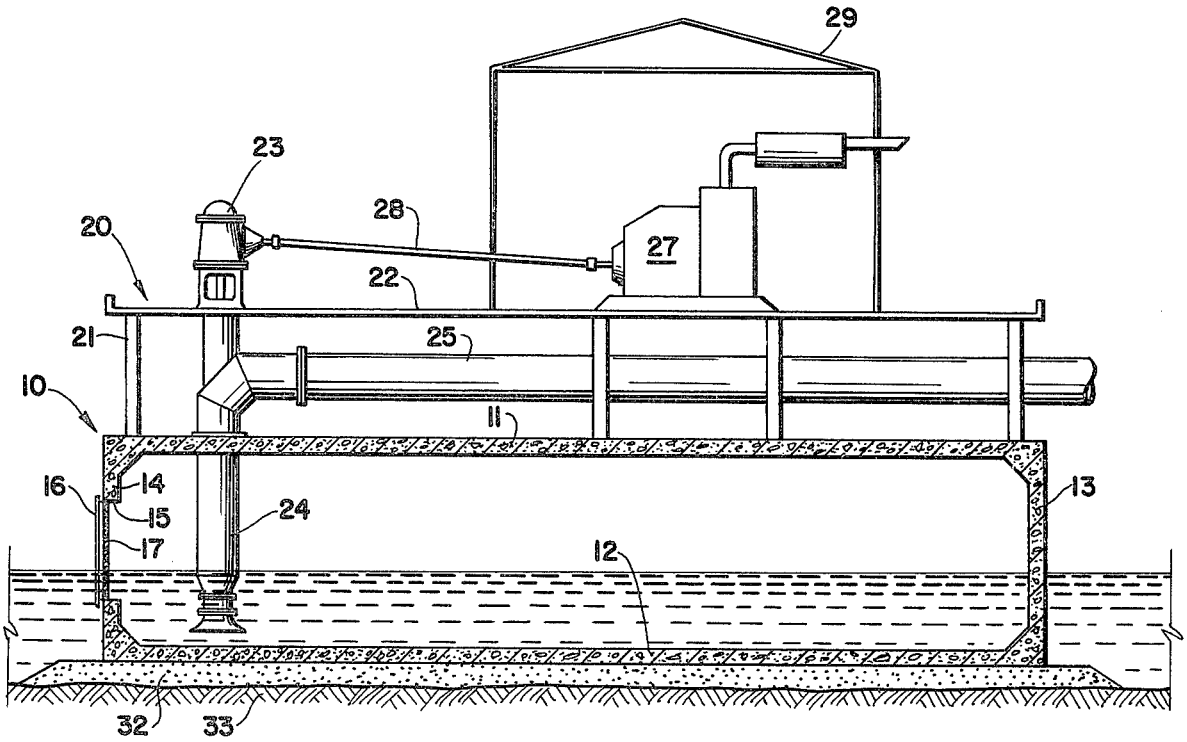
FIG. 5 is a longitudinal sectional view of a pumping station constructed in accordance with the present invention flooded down at a pumping site.

With a bed of oyster shells or the like 32 upon the mud bottom 33 the barge 10 is flooded down from the buoyant transport condition of FIG. 4 to the pumping condition of FIG. 5 by removing the covers 16 from the openings 15 in the rear wall 14 so that water enters the barge interior through screens 17. The screens 17 permit free water entry without permitting trash and debris to enter the interior of the barge where it could clog or restrict free intake for each pump.

When it is desired to relocate the pumping station the covers 16 are put back to the position of FIG. 5 and the water is pumped from the flooded condition of FIG. 5 by one of the pumps 23 until it is refloated to the transport condition of FIG. 4 at which time the tugboat 30 tows it to the new location.

What I claim is:

1. A water transportable pump station comprising a floatable-submergible concrete barge comprising a top and bottom, side and end walls, at least one of said end walls having a flood opening therethrough, a pump support superstructure secured to the top of said concrete barge, at least one pump secured to the superstructure on top thereof and having an intake extending vertically within and above said barge, a pump driving prime mover carried by said superstructure and connected to drive said pump, flooding means including a cover and a screen for said opening in one end wall of the barge for flooding the barge with the water to be pumped above the pump intake level, and discharge means for discharging the water pumped from the pump to the other side of a barrier adjacent the barge.

2. A water transportable pump station as claimed in claim 1 wherein a plurality of pumps are carried by the superstructure with their intakes within the barge structure.

* * * * *